US006957715B2

(12) United States Patent
Christiansen

(10) Patent No.: US 6,957,715 B2
(45) Date of Patent: Oct. 25, 2005

(54) GARDEN SPEAKER

(76) Inventor: Carl Christiansen, 769 Old York Rd., Burlington, Ontario (CA), L7P 4X8

( * ) Notice: Subject to any disclaimer, the term of this patent is extended or adjusted under 35 U.S.C. 154(b) by 0 days.

(21) Appl. No.: 10/347,227

(22) Filed: Jan. 21, 2003

(65) Prior Publication Data

US 2003/0141142 A1 Jul. 31, 2003

Related U.S. Application Data

(60) Provisional application No. 60/350,998, filed on Jan. 25, 2002.

(51) Int. Cl.[7] ..... A47B 81/06
(52) U.S. Cl. ..... 181/199; 181/198
(58) Field of Search ..... 181/199, 198, 181/175, 179, 180, 182, 189, 190, 192, 196, 197, 148, 149, 160, 155, 176; 381/345, 350, 160

(56) References Cited

U.S. PATENT DOCUMENTS 3,750,838 A 8/1973 Pyle, Jr. ..... 181/31
4,168,761 A * 9/1979 Pappanikolaou ..... 181/156
4,754,852 A * 7/1988 Mule et al. ..... 181/149
5,404,343 A 4/1995 Boggio ..... 369/19
5,444,194 A 8/1995 Reinke ..... 181/150
5,731,553 A * 3/1998 Ledoux ..... 181/156
6,056,083 A 5/2000 Daniell ..... 181/198

* cited by examiner

*Primary Examiner*—Kimberly Lockett
(74) *Attorney, Agent, or Firm*—Edward H. Oldham

(57) ABSTRACT

A sound producing rock having a matching body and a cap such that the cap is supported above the body in a spaced relationship to give the illusion that the cap and body are a monolithic structure. The cap and body are produced by sawing the cap from the body. A cavity is formed in the body by drilling a borehole in the body which extends downwardly from the flat body surface. A speaker is mounted in the cavity to project sound upwardly against the flat surface of the cap so that sound is projected outwardly from the space formed between the cap and body.

6 Claims, 3 Drawing Sheets

GARDEN SPEAKER

This application claims the benefit of provisional application No. 60/350,998, filed Jan. 25, 2002.

BACKGROUND OF THE INVENTION

The present invention relates to an outdoor sound producing device suitable for producing sound for lawns, patios, gardens etc. whilst simultaneously having the appearance of a stone. Prior art sound devices useful in gardens etc. have been composed of concrete etc. and may be disguised in the form of an urn, a resonant cone, or some sort of an architectural form whilst simultaneously having the ability to emit sound. However, this invention makes use of natural stone as a receptacle for the ultimate sound producing apparatus.

Prior art devices such as described above, are not easily hidden in the landscape architecture because of the artificiality expressed in the external appearance of the sound producing apparatus; however, because the device of this invention is made of naturally occurring rock, the concealment of the device in a landscape is relatively easy.

Because of the nature of the prior art devices, placement of such apparatus for producing sound may be limited to locations where the production of sound is not the most desirable for the production of the desired effect. For instance, a speaker system incorporated into an architectural column in a building may not be located at the most desirable location to produce the desired psychoacoustic effect. For instance if a landscape designer wishes to produce sound for the benefit of pedestrians who are strolling through the lawns and gardens located at some distance from the building in which the sound producing apparatus is located, the aesthetic effect may be lost due to the distance the sound must travel. This problem is solved by the invention disclosed here and it will provide a ready solution to problems of the prior art devices.

SUMMARY OF THE INVENTION

The garden loudspeaker of this invention comprises a natural stone body (preferably limestone) which has an external shape selected by a landscape designer. The initial stone is sliced (usually with a diamond saw) to produce two pieces each having conjugate flat surfaces, a body and a cap. The body of the stone is bored in a direction perpendicular to the plane of the flat surface produced by cutting the body, to produce a through hole extending from the flat cut surface, right through the body. This borehole provides an access to the body for the insertion of sound cables, etc. through the stone to connect to a speaker. At least one speaker cavity is produced by counterboring a large bore which forms a chamber in the body for mounting a speaker (s) in the body of the stone. The cap is replaced and supported just above the body to present the stone speaker as a naturally occurring stone (except for the slot appearing between the cap and the body).

PERTINENT PRIOR ART

U.S. Pat. No. 6,056,083 May 2, 2000

This patent describes stereophonic or multichannel loudspeaker systems that mimic architectural columns or corbels. Shown particularly is a corbel and a pillar each disguising a system of loudspeakers incorporated in the construction thereof to produce sound. The pillar shows a central support 37 in FIG. 3 which houses 5 or 6 speakers. A surrounding shield 31 in the form of a truncated cone presents an exterior surface which mimics an architectural column.

U.S. Pat. No. 5,404,343 Apr. 4, 1995

This patent describes a gravestone marker having a sound system incorporated therein. No attempt is made to disguise the gravestone as a sound-producing device.

U.S. Pat. No. 5,444,194 Aug. 22, 1995

This patent shows a decorative vase or urn having a speaker system mounted within the urn. A bass or "woofer" speaker is oriented to produce sound in a downward direction whilst a "tweeter" is mounted in the "lid" of the urn to project high frequency sound in an upward direction.

U.S. Pat. No. 4,754,852 Jul. 5, 1988

This patent shows an outdoor cabinet which houses a plurality of speakers. The cabinet is made to simulate a natural rock or stone and at the same time provides a housing which also functions to protect the loudspeakers and augment the physioacoustic effect of the sound-producing device.

U.S. Pat. No. 3,750,838 Aug. 7, 1975

This patent describes a tuned speaker assembly in which a tapered concrete cone "chokes" the sound emitted by a loudspeaker while simultaneously directing the sound produced by the speaker upwardly to the ceiling above the concrete cone. No attempt is made to disguise the speaker system of this patent as a rock.

DESCRIPTION OF THE PREFERRED EMBODIMENT

Figure 1:
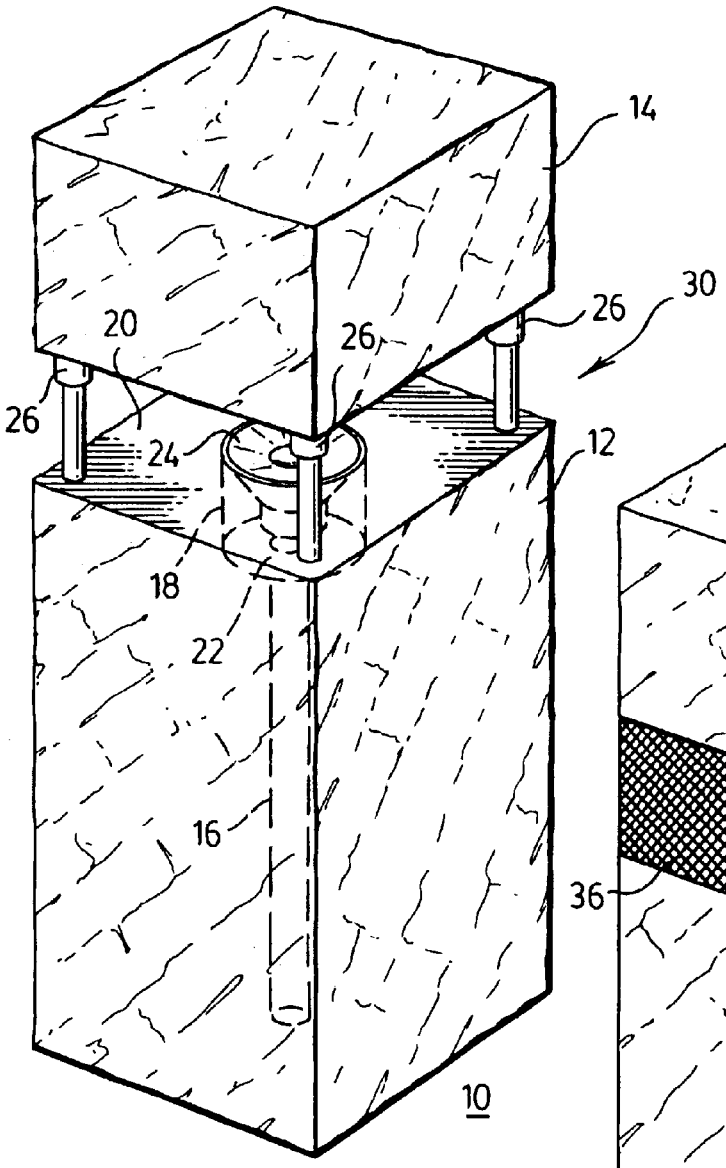
FIG. 1 is a perspective view of a rock speaker of this invention.

Referring now to FIG. 1, a perspective view of a ROCK SPEAKER 10 is shown. Speaker 10 comprises a block of stone (preferably limestone) which has been previously shaped (in this instance) to have a rectangular appearance. The initial stone block 10 is sawed into two pieces; a body 12 and a cap 14. This means that the cap 14 and body 12 each are left with a flat surface which is a conjugate of the other.

When the body 12 is separated from cap 14, the body 12 is drilled with a suitable rock drill to form a borehole 16 which provides a passageway completely through the body 12. A counter boring operation produces a speaker cavity 18 in body 12 extending from the top surface 20 of the body 12 to surface 22. A speaker 24 is placed in the cavity 18. Next an audio signal wire for speaker 24 is passed through bore 16 to supply sound energy to the speaker 24. The speaker 24 may be permanently mounted in cavity produced by counterbore 18 by any suitable means. (The speaker 24 may for instance be cemented to surface 20 surrounding cavity 18.)

The cap 14 is now placed on supports 26 which maintain cap 14 a predetermined distance above body 12. Supports 26 (metal, plastic etc.) may be provided with locks to prevent unwanted removal of cap 14 from body 12. A grill cloth may be placed around the opening 30—between the cap 14 and body 12 to obscure the speaker 24 or other acoustic components. This construction provides an omnidirectional rock speaker in which the sound produced by speaker 24 bounces off the lower surface of cap 14 and radiates in all directions through opening 30.

Figure 2:
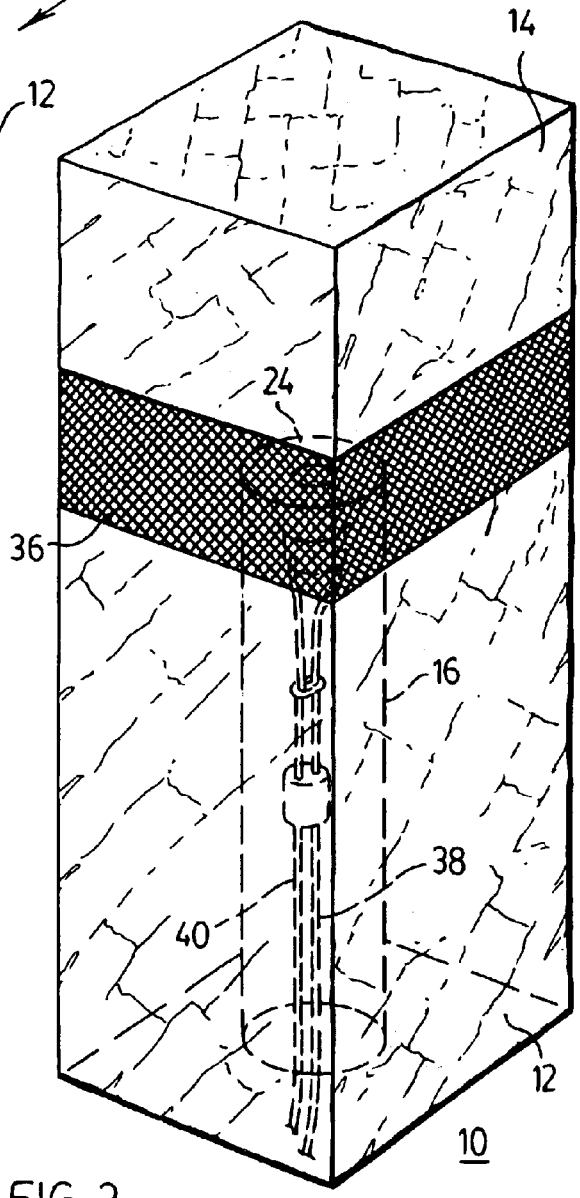
FIG. 2 is a pictorial illustration of the speaker of FIG. 1.

FIG. 2 shows a speaker rock 10 similar to the example of FIG. 1 except grill cloth 36 is shown in place. Wires 38, 40 are shown in bore 16 to drive speaker 24. The grill cloth 36 may be fabric or metallic.

Figure 3:
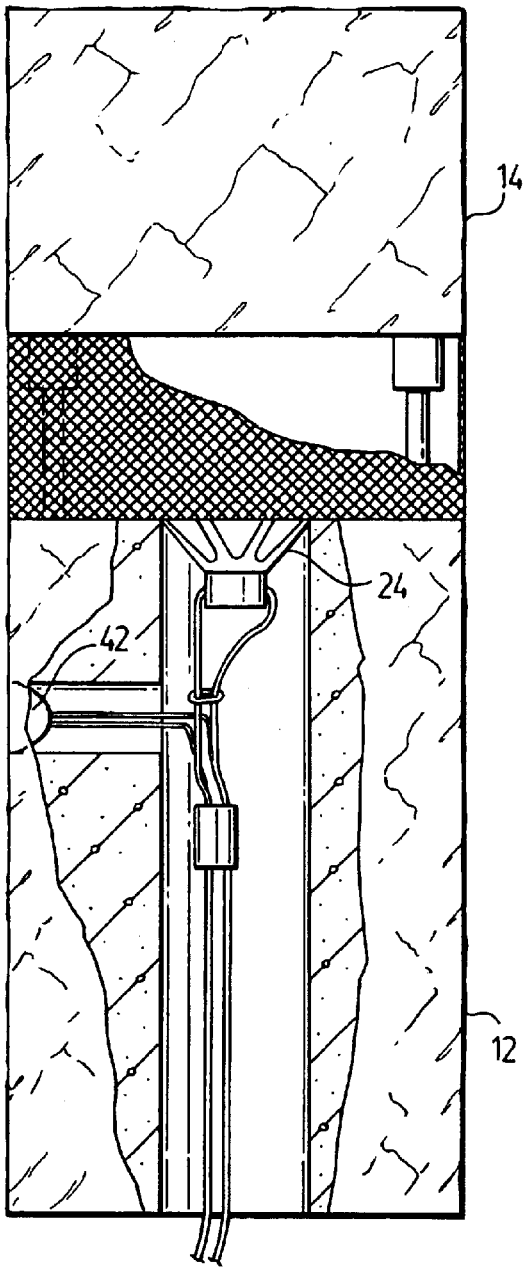
FIG. 3 is a rock speaker similar to that shown in FIG. 2 but having a tweeter installed in the body.

FIG. 3 shows a speaker system similar to FIG. 2 except that tweeter 42 is provided in the rock body below speaker 24.

Figure 4:
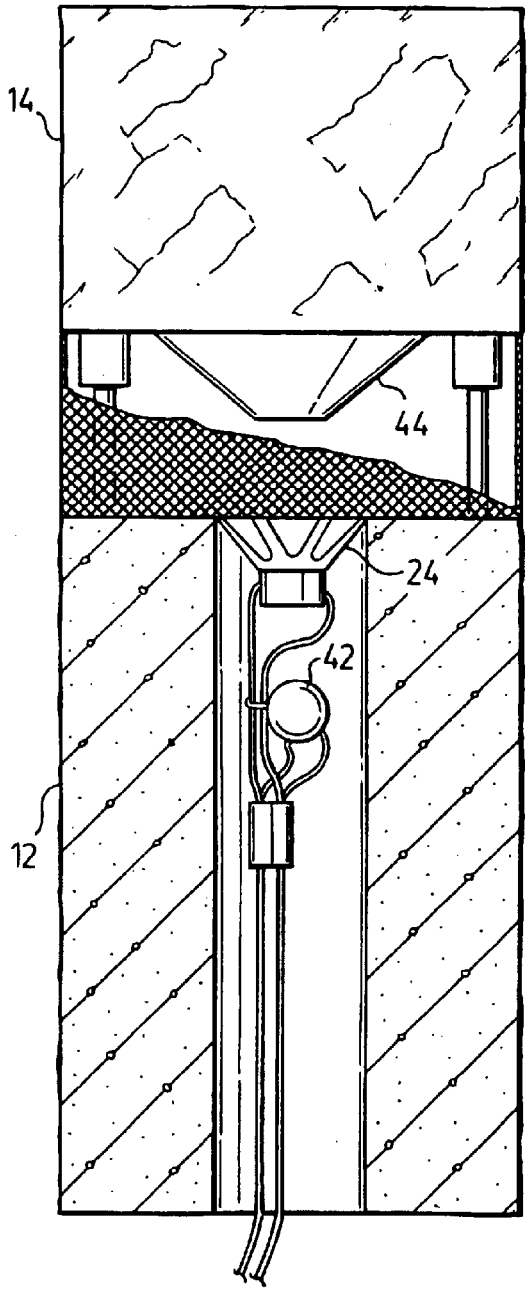
FIG. 4 is a rock speaker similar to that shown in FIG. 3 except a sound diffuser is mounted on the lower surface of the cap.

FIG. 4 shows a speaker rock similar to FIG. 3 but a sound diffuser 44 is provided on the lower surface of the cap 14.

Figure 5:
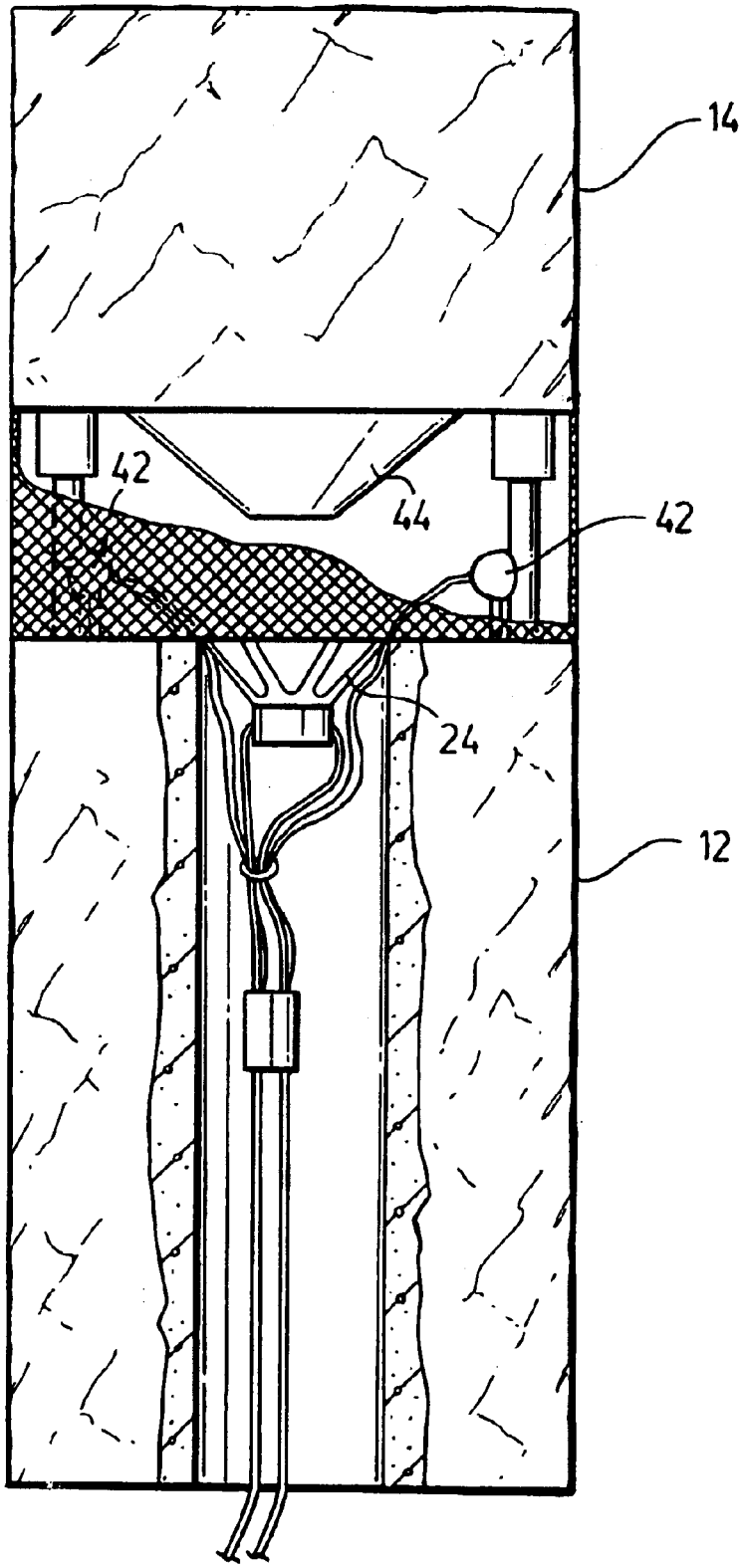
FIG. 5 shows a rock speaker having tweeters installed in the space between body and cap.

FIG. 5 shows a rock speaker having a sound diffusion cone 44 in place and a pair of tweeter speakers mounted in space 30 between cap 14 and body 12. P The rock comprising the speaker 10 may be any shape but for simplicity a speaker rock has been chosen which has rectangular characteristics. This is not necessary.

Speaker 24 may be installed in counterbore 18 in any suitable manner, usually with a suitable adhesive material.

The speaker systems of this invention utilize a natural rock to house the loudspeakers which produce the sound emitted by the completed combination. The emitted sound will be found to be esthetically pleasing, because of the mass of the containment structure housing the loudspeaker. The sound produced by the speaker which projects sound upwardly against the lower surface of the cap 14 of the diffuser such as 44 so that it will be propagated in all directions to produce an omnidirectional sound distribution.

It will be obvious to those skilled in the acoustic art that for woofer or midrange speakers, the stone enclosure disclosed herein will produce an omnidirectional sound output. With the higher frequency tweeter speakers the emitted sound tends to be quite directional when compared to the midrange or woofer speakers, and it will be found that any reflected high frequency sound tends to be severely attenuated. For this reason, it may be desirable to place a plurality of tweeter speakers in space 30 to produce a full frequency range of emitted sound which will be substantially omnidirectional.

The speaker 24 may be a single speaker or it may be a co-axial speaker depending on the application. For outdoor applications, of course, the speaker must be weather resistant.

Of course there will be opportunities to fabricate a simulated rock from concrete or polymer, however the applicant is satisfied with the use of natural rock.

The cavity produced by the counterbore 18 (of FIG. 1) may be adjusted to change the resonant characteristics of the speaker mounted in the cavity produced. Any method of mounting the speaker above the cavity must ensure that the speaker 24 is securely attached to the body 12.

Variations and alterations will be obvious to those skilled in the art but applicant prefers to limit the ambit of his invention by the scope of the following claims.

What is claimed:

1. A rock speaker for use in a garden, patio, lawn etc. comprising a rock body and a matching rock cap, said body and cap each exhibiting a flat conjugate surface produced by sawing said cap from said body, said body being positioned so that the flat surface faces upwardly, said cap being supported above said flat surface of said body a predetermined distance, so that said flat surfaces of said cap and body face each other and form a space therebetween, a chamber formed in said body extending downwardly from said flat surface a predetermined selectable distance, speaker means mounted in said chamber to project sound upwardly against said flat surface of said cap.

2. A rock speaker as claimed in claim 1 wherein said cap is supported on said body by a plurality of pedestal supports surrounding said chamber.

3. A rock speaker as claimed in claim 2 wherein a truncated cone diffuser is mounted on said flat surface of said cap above said speaker means.

4. A rock speaker as claimed in claim 3 wherein a plurality of tweeter speakers is mounted in the space between said cap and said body.

5. A rock speaker as claimed in claim 1 wherein tweeter speaker means is mounted in said body to project sound outwardly from said body.

6. A method of making a garden speaker comprising:

providing a suitable rock for the purpose, cogitating and examining the rock, determining the location of a suitable cut in the rock, sawing said rock to produce a rock body and a rock cap, each having a matching flat surface, boring a hole in said rock body from a selected location on said flat surface of said rock body to penetrate and pass through said rock body, removing rock at said flat surface of said rock body to form a cavity in said rock body which extends below said flat surface and is in communication with said hole, passing suitable wires through said hole into said cavity, installing a speaker in said cavity to radiate sound upwardly from said cavity, connecting said wires to said speaker, supporting said rock cap above said rock body a predetermined distance on suitable pedestals, energizing said wires with a suitable signal.

* * * * *